US005998072A

United States Patent [19]

Mochizuki et al.

[11] Patent Number: 5,998,072

[45] Date of Patent: Dec. 7, 1999

[54] ELECTROPHOTOGRAPHIC PHOTORECEPTOR, AND AN IMAGE-FORMING METHOD AND APPARATUS FOR USING THE SAME

[75] Inventors: Fumitaka Mochizuki; Kenichi Yasuda; Mieko Toyama, all of Tokyo, Japan

[73] Assignee: Konica Corporation, Tokyo, Japan

[21] Appl. No.: 09/036,932

[22] Filed: Mar. 9, 1998

[30] Foreign Application Priority Data

Mar. 13, 1997 [JP] Japan ..... 9-059360
Mar. 13, 1997 [JP] Japan ..... 9-059361

[51] Int. Cl.[6] ..... G03G 15/04

[52] U.S. Cl. ..... 430/64

[58] Field of Search ..... 430/64

[56] References Cited

U.S. PATENT DOCUMENTS 5,190,837 3/1993 Sakai et al. ..... 430/58

FOREIGN PATENT DOCUMENTS 58-93062 6/1983 Japan .
62-272277 11/1987 Japan .
3-73962 3/1991 Japan .
4-36758 2/1992 Japan .

*Primary Examiner*—Mark Chapman
*Attorney, Agent, or Firm*—Frishauf, Holtz, Goodman, Langer & Chick, P.C.

[57] ABSTRACT

An electrophotographic photoreceptor and image forming manhood using the same are disclosed. The photoreceptor comprises a sublayer between the support and the photosensitive layer containing fine resin particles. A clear and sharp image is formed without generating interference fringes.

19 Claims, 2 Drawing Sheets

ELECTROPHOTOGRAPHIC PHOTORECEPTOR, AND AN IMAGE-FORMING METHOD AND APPARATUS FOR USING THE SAME

FIELD OF THE INVENTION

The present invention relates to an electrophotographic photoreceptor employed for the formation of images in copiers, printers, in-house printing apparatuses, etc., and an image-forming method and an image-forming apparatus for using the same.

BACKGROUND OF THE INVENTION

Currently, electrophotographic image-forming apparatuses are regarded as the constitution which is most suitable for meeting requirements for the high-speed production of quality images, and bearing of small dimensions for optimizing use of space saving in an office.

In recent years, in high demand have been output apparatuses for computers or output apparatuses capable of performing various image processing. Specifically, these are laser beam printers (hereinafter referred to as LBP) or digital copiers.

The photoreceptors which can be employed in such apparatuses are required to exhibit sufficient sensitivity for long wavelength radiation generated by light sources such as semiconductor lasers and the like. Therefore, recently, phthalocyanine compounds have received much attention as a charge generating material (abbreviated as "CGM") having a high sensitivity even in the long wavelength region. The phthalocyanine compounds are classified into two main categories, that is, metallic phthalocyanines and nonmetallic phthalocyanines and a variety of compounds have been proposed. Of those, titanylphthalocyanines (hereinafter referred to as "TiOPc") have received considerable attention as the CGM from which can be realized high sensitivity and quality images. The TiOPc exhibits sufficient sensitivity in the long wavelength region, specifically the range between 600 and 850 nm (hereinafter, the term "long wavelength region" will refer to this wavelength region). Therefore, the TiOPc is a markedly suitable material for preparing the photoreceptor for the image-forming apparatus comprising a light source having the maximum radiation energy in this wavelength region such as semiconductor laser, LED, EL (electroluminescence), LCD (liquid crystal shutter), etc.

However, as the resolution of images is improved, there have been problems with grained interference fringes (Moiré image). As to the reason for these problems, when an exposure light source is coherent light of a long wavelength, the light is not totally absorbed by a photosensitive layer, and the transmitted light is subjected to regular reflection from the support surface. As a result, multipath reflection of the light of the laser beam is generated in the photosensitive layer, and it is assumed that interference is caused between the multipath reflected light and reflected light from the surface of the photosensitive layer.

In order to eliminate this phenomenon, a method is employed in which the electrically conductive surface of a support is intentionally roughened and the formation of interference is prevented by scattering the light transmitted through the photosensitive layer. However, when the surface is excessively roughened, traces from processing the support appear in the image. On the other hand, when the surface roughness is not enough, a Moiré pattern is generated. It has been difficult to maintain uniform and appropriate roughness on the surface of the support in the production process.

The photoreceptor is basically composed of an electrically conductive support and a photosensitive layer. However, in order to improve the adhesion of the support to the photosensitive layer, to prevent image defects caused by the charge injection from the electrically conductive support, to improve charging properties of the photoreceptor, and the like, in many cases, a sublayer is provided between the electrically conductive support and the photosensitive layer.

Particularly, in the reversal development process employed in a laser printer, image defects such as micro black points known as black spots (in the case of normal development, white spots on the solid black image), transfer memory, etc. are frequently generated. In order to minimize such image defects, a sublayer (occasionally termed an interlayer) having better quality, has been desired. As the sublayer, for example, a resin layer comprising a polyamide resin, a polyester resin, a polyurethane resin is listed and is most generally employed.

When such a sublayer, composed of a resin layer, is employed in combination with an imidazoleperylene compound or TiOPc, images excellent in contrast and resolution are obtained even though the resulting combination is employed in a high speed machine. However, such excellent quality is obtained only when employed under environmental conditions such as normal temperature and humidity and is only obtained during an initial period. When employed under specific environmental conditions such as high temperature and humidity or low temperature and humidity, or for the continuous production of a number of copies, several problems are caused.

For example, at high temperature and humidity, the resistance of the resin layer increases and the barrier properties increase. As a result, problems are caused such that the sensitivity decreases and after repeated use, the residual electric potential increases. Particularly, when TiOPc is employed as a CGM, the charge generating capability of TiOPc may be degraded and the above-mentioned problems are markedly increased.

As shown above, when the imidazoleperylene compound or TiOPc is employed in combination with the resin layer as a sublayer, some advantages are achieved. On the contrary, however, major problems such as formation of white spots (or black spots), deterioration of electric potential characteristics, etc. are caused.

As a means to solve those problems, Japanese Patent Publication Open to Public Inspection No. 58-93062 discloses the formation of a sublayer by mixing a resin with a metal alkoxide compound or an organic metal compound, and furthermore, a technique for the formation of a sublayer employing an organic metal compound or a silane coupling agent, without the use of a resin.

For example, in Japanese Patent Publication Open to Public Inspection No. 62-272277, metal alkoxide compounds and silane coupling agents are employed. Furthermore, in Japanese Patent Publication Open to Public Inspection Nos. 3-73962, 4-36758, etc., a zirconium chelating compound and a silane coupling agent are employed in combination.

In the electrophotographic photoreceptor in which writing is performed with a laser beam, a grained image defect (Moiré pattern) is formed by the interference of a laser beam caused by unevenness in the thickness of the photoreceptor layer. The defect is markedly generated when an organic metal series sublayer is employed which exhibits a larger reflection ratio, which is thicker than that composed of a resin. As a method to prevent such problems, for example, it is has been shown that if the surface of a support is intentionally roughened, the generation of interference light is prevented by scattering the incident light. However, the prevention is not complete. Furthermore, when the surface is excessively roughened, an uneven surface is formed on the photosensitive layer and troubles such as poor cleaning result.

SUMMARY OF THE INVENTION

A purpose of the present invention, in a photoreceptor which employs a light source generating light capable of being subjected to interference, is to form a clear and sharp image without generating interference fringes and processing traces of an electrically conductive support.

Another object of the present invention, in a photoreceptor in which writing is carried out employing a laser beam, is to form a clear and sharp image without generating a Moiré pattern.

The electrophotographic photoreceptor of the present invention comprises an electrically conductive support having thereon a photosensitive layer, and a sublayer containing fine resin particles between the photosensitive layer and the electrically conductive support.

Examples of resins employed for resin particles include silicone resin, polymethacrylate (PMMA), polystyrene, crosslinked polystyrene, acrylic resin, styrene/acrylic resin, melamine resin, benzoguanamine/melamine resin, phenol resin, polytetrafluoroethylene (PTFE), synthetic rubber, n-butylacrylate, urea resin, polyfluorovinylidene, urethane resin and cellulose acetate. Fine particles of any of these resins may form a sublayer when employed together with a binder such as a resin.

The difference between refractive index of the binder of the sublayer and that of the fine resin particle is preferably 0.07 or more and more preferably from 0.1 to 0.3.

The number average particle diameter of the resin particles is preferably 0.001 to 5 $\mu$m, more preferably 0.04 to 1 $\mu$m.

The mixing weight ratio of the binder of the sublayer to the fine resin particles is preferably in the range of fine resin particles/binder=1/10 to 50/10, preferably 1/10 to 10/10, and more preferably 3/10 to 5/10.

The thickness of the sublayer is preferably from 0.05 to 10 $\mu$m, and more preferably 0.2 to 1 $\mu$m.

The resistance of the resin particle is preferably not less than $10^7$ $\Omega$·cm.

The sublayer of the present invention may be composed of fine resin particles, and an organic metal compound selected from metal chelate compounds or a silane coupling agent. The organic metal compound and the silane coupling agent may be employed in combination. When the organic metal compound and the silane coupling agent are employed in combination, the sublayer may partially comprise the reaction product of those.

The mixing weight ratio of the organic metal compound selected from metal chelate compounds or a silane coupling agent of the sublayer to the fine resin particles is preferably in the range of fine resin particles/binder=1/10 to 50/10, preferably 1/10 to 10/10, and more preferably 3/10 to 5/10.

This electrophotographic photoreceptor is adapted to an image-forming process in which digital writing is performed employing a laser beam. A laser beam is coherent light, which enhances the Moire image frequently when using conventional sublayer. The sublayer of the invention reduces the Moiré image.

This photoreceptor is also employed preferably for an image-forming method in which on an electrophotographic receptor, are formed images by superimposing a plurality of colored toners and are simultaneously transferred to a transfer sheet. In this image-forming method Moiré image is formed frequently using conventional sublayer. The problem is dissolved markedly according to the invention.

Surface roughness of the electric conductive support is preferably Rz=0.05 to 2.5 $\mu$m, and more preferably 0.1 to 1.5 $\mu$m. Rz is defined in Item 5 of JIS B 0601.

REFERENCE NUMERALS

Figure 1:
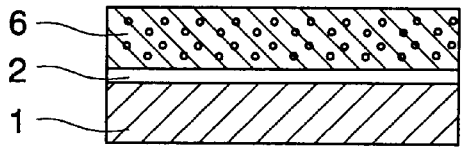
FIGS. 1(*a*)–1(*f*) show sectional views of layer structures of the photoreceptor according to the present invention.
Figure 1:
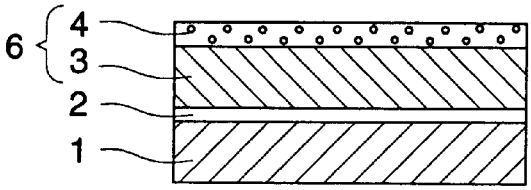
Figure 1:
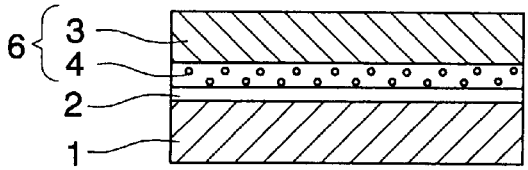
Figure 1:
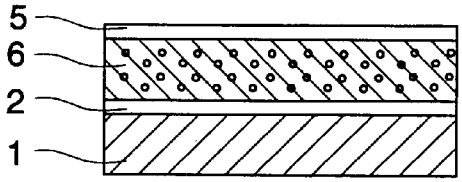
Figure 1:
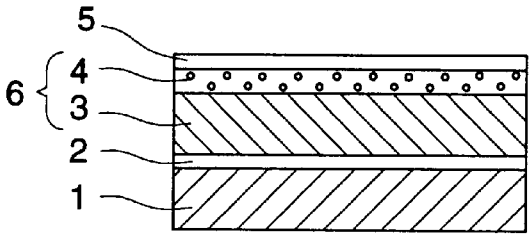
Figure 1:
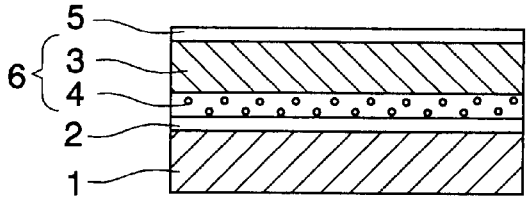

1 Electrically conductive support
2 Sublayer
3 Charge transport layer (CTL)
4 Charge generating layer
5 Protective layer
6 Photosensitive layer
10 Photoreceptor drum
11 Exposure section employing light-emitting diode, etc.
12 Scorotron charging device
13 Image exposure means
14 Development device
17 Paper-feeding roller
18 Transfer roller
19 Separation brush
20 Fixing device
21 Paper-ejecting roller
22 Cleaning device
30 Removable cartridge in which a photoreceptor drum, charging means, development means and cleaning means are integrally united
P Transfer sheet

DETAILED DESCRIPTION OF THE INVENTION

As fine resin particle material comprising fine resin fine particle provided on an electrically conductive support, those are preferred which are selected from silicone resin, polymethacrylate (PMMA), polystyrene, crosslinked polystyrene, acrylic resin, styrene/acrylic resin, melamine resin, benzoguanamine/melamine, phenol resin, polytetrafluoroethylene (PTFE), synthetic rubber, n-butylacrylate, urea resin, polyfluorovinylidne, urethane resin, cellulose acetate. Furthermore, additives such as pigments, etc. may be incorporated in the above-mentioned materials. Resins such as those which absorb light having the above-mentioned long wavelength region are preferred.

One example of the sublayer comprises fine resin particles and a binder. The sublayer is provided by coating a liquid prepared by dissolving a resin to be a binder in a solvent followed by adding fine particles.

The particle diameter of 0.001 to 5 $\mu$m of the fine resin particle enables practically to form a sublayer and to acquire excellent electrophotographic characteristics. Furthermore, in order to prevent the formation of a Moiré image, the particle diameter is preferably from 0.05 to 2 $\mu$m.

The thickness of the sublayer is preferably from 0.05 to 10 $\mu$m and most preferably from 0.05 to 5 $\mu$m.

Polyamide series resins are preferably employed as a binder of the sublayer, and additives may be incorporated, if desired. The resin used for the sublayer is dissolved in a solvent that does not dissolve the fine resin particles. The example thereof includes alcohol such as methanol or butanol.

Another example of the sublayer comprising fine resin particles employed in the present invention is formed by an organic metal compound or a silane coupling agent, or by a reaction product formed by those. This sublayer is occasionally termed a ceramic type or hardening type sublayer. The organic metal compound and/or a silane coupling agent are diluted by a solvent to prepare a coating liquid. To this liquid, fine resin particles and other additives if desired are added and the resulting liquid is coated and dry hardened and thus the sublayer is formed.

The hardening type sublayer comprises, as main components, an organic metal compound or a silane coupling agent, or reaction products formed from those, and may comprises raw materials of the above-mentioned reaction products and other components.

The organic metal compounds include metal alkoxides and metal chelate compounds. Kinds of metals which form this compound include titanium, zirconium, aluminum, etc.

Metal alkoxides include tetrapropoxytitanium, tetrabutoxytitanium, tetrapropoxyaluminum, tetrabitoxyzirconium, etc.

Types of chelate groups forming metal chelate compounds include:

(1) b-diketone such as acetylacetone, 2,4-heptanedione, etc.
(2) keto esters such as methylacetoacetate, ethylacetoacetate, propylacetoacetate, butylacetoacetate, etc.
(3) hydroxycarboxylic acids such as lactic acid, salicylic acid, malic acid, etc.
(4) hydroxycarboxylic acid esters such as methyl lactate, ethyl lactate, ethyl salicylate, ethyl maliate, etc.
(5) glycols such as octanediol, hexanediol, etc.
(6) ketoalcohols such as 4-hydroxy-4-methyl-2-pentanone, etc.
(7) aminoalcohols such as triethanolamine These compounds include:

diisopropoxytitaniumbis(acetylacetate)
butoxyzirconiumtri(acetylacetate)
diisopropoxytitaniumbis(ethylacetate)
diisopropoxyaluminmbis(ethylacetate)
diisopropoxytitaniumbis(lactate)
dibutoxytitaniumbis(octyleneglycolate)
diisopropoxytitaniumbis(triethanolaminate) and the like Of these, compounds having a b-diketone group and a ketoester chelate group exhibit excellent electric potential and image characteristics and specially, compounds having both of a chelate group and an alkoxy group are preferred.

Organic metal compounds having the structure described below are preferred.

$$(RO)_m MX_n$$

wherein R represents an alkyl group; M represents titanium, zirconium or aluminum; X represents a chelate forming group such as an acetoacetate ester or b-diketone residual group; m and n each independently represent an integer of 1 or more. However, when M is titanium or zirconium, m+n is 4, while when M is aluminum, m+n is 3.

On the other hand, silane coupling agents have preferably structures described below.

$$(Z)_a(A)_b Si(Y)_c$$

wherein Z represents a hydrolyzable group (for example, an alkoxy group, a halogen atom or an amino group); A represents an alkyl group or an aryl group; Y represents an organic functional group; a, and b represents an integer of 1 or more; b represents an integer of 0 or more, and a+b+c=4.

Types of terminal groups of the functional groups which vary markedly the characteristics include:

g-methacryloxy group
g-amino group
N-phenyl-g-amino group
N-b-(aminoethyl)-g-amino group
g-glycydoxy group
b-(3,4-epoxycyclohexyl) group
g-chloro group
g-mercapto group and the like.

The compounds include:

g-aminopropylmethoxysilane
N-b-(aminoethyl)-g-aminopropyltrometoxysilane
N-ohenyl-g-aminopropyltrimethoxysilane
g-methacryloxypropyltrimethoxysilane
g-glycidoxypropylmethoxysilane
b-(3,4-epoxycyclohexyl)trimetoxysilane
g-chloropropyltrimethoxysilane
g-mercaptopropylmethoxysilane and the like.

Of these, compounds having a functional group having a g-methacryloxy group, a g-amino group or an N-phenyl-g-amino group at the terminal exhibit excellent characteristics of both electric potential and image.

Preferred coupling agents are those in which the functional group represents —LOOC(R')C=$CH_2$, —LNHR" or —$LNH_2$; R' represents an alkyl group or an aryl group and L represents an alkylene group or an alkylene group having —O—, —NH— or —CO—.

The sublayer is provided by that the organic metal compound and/or the silane coupling agent as itself or mixture thereof is mixed with fine resin particles and then coated. The organic metal compound and/or the silane coupling agent may be diluted with an adequate solvent such as isopropyl alcohol if necessary, and is then mixed with the fine resin particles.

The representative layer structure of the photoreceptor which is applied to the present invention is described. FIG. 1(*a*) shows a photoreceptor having a single-layered structure comprising both a charge generating material (CGM) and a charge transport material (CTM) on an electrically conductive support 1 via a sublayer 2. FIG. 1(*b*) shows a photoreceptor composed of a layered structure comprising an electrically conductive support having thereon a charge transport layer (CTL) 3 having a charge transport material (CTM) as main component and a charge generating layer (CGL) 4 having a charge generating material (CGM) as a main component in this order via a sublayer 2. FIG. 1(*c*) shows a photoreceptor composed of a layered structure comprising an electrically conductive support 1 having thereon, via a sublayer 2, a charge generating layer (CGL) 4 and a charge transport layer (CTL) 3 in this order.

Of these layer structures, particularly preferred structure is that shown in FIG. (c).

Furthermore, FIGS. 1(*d*), 1(*e*) and 1(*f*) show structures in which protective layers 5 are layered on FIGS. 1(*a*), 1(*b*) and 1(*c*), respectively.

When the protective layer is provided, it comprises preferably the charge transport material (CTM). Incorporation of the charge transport material (CTM) in those protective layers may prevent an increase in residual electric potential and a decrease in sensitivity during repeated use of a photoreceptor.

The charge generating layer is formed by dispersing a charge generating material (CGM) into a binder resin, if desired. CGM include charge transfer complexes composed of trinitrofluorenone with metallic or nonmetallic phthalocyanine compounds, bisazo compounds, perylene series compounds, indigo compounds, quinacridone compounds, polycyclic quinone series compounds, cyanine dyes, xanthene dyes, poly-N-vinylcarbazole, etc. Furthermore, these may be employed in combination of 2 or more, if desired. However, in order to accomplish the object of the present invention to the highest level, one of the perylene compounds, one of imidazoleperylene compound or metal phthalocyanine compound and titanylphthalocyanine (TiOPc) are preferred.

Charge transport materials (CTM) incorporated in the photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazoline derivatives, styryl compounds, hydrazine compounds, benzidine compounds, pyrazoline derivatives, stylbene compounds, amine derivatives, oxazolone derivatives, benzothiazole derivatives, benzimidazole derivatives, quinazoline derivatives, benzofuran derivatives, acridine derivatives, phenadine derivatives, aminostylbene derivatives, poly-N-vinylcarbazole, poly-1-vinylpyrene, poly-9-vinylanthracene, etc., and these charge transfer materials (CTM) are generally employed to form a layer together with a binder.

Binder resins incorporated in the single-layered photosensitive layer 6 and layer-structured charge generating layer (CGL) and charge transport layer (CTL) include polyester resins, polystyrene resins, methacrylic resins, acrylic resins, polyvinyl chloride resins, polyvinylidene chloride resins, polycarbonate resins, polyvinylbutyral resins, polyvinyl acetate resins, styrene-butadiene resins, vinylidene chloride-acryronitrile copolymer resins, vinyl chloride-maleic acid anhydride resins, urethane resins, silicone resins, epoxy resins, silicone-alkyd resins, phenol resins, polysilane resins, polyvinylcarbazole, etc.

The ratio of a charge generating material to a binder resin in a charge generating layer is preferably between 1:5 and 5:1 by weight. The thickness of the charge generating layer is preferably 5 $\mu$m or less and most preferably between 0.05 and 2 $\mu$m. Furthermore, the amount of residual solvent in the charge generating layer is preferably 2 percent by weight or less.

The charge transport layer is formed by dissolving the above-mentioned charge transport material and binder resin in an appropriate solvent and by coating the resulting solution followed by drying. The mixing ratio of the charge transport material to the binder resin is preferably between 3:1 and 1:3 by weight.

The thickness of the charge transport layer is preferably between 5 and 50 $\mu$m and most preferably between 10 and 40 $\mu$m. Furthermore, when a plurality of charge transport layers are provided, the thickness of the uppermost charge transport layer is preferably not thicker than 10 $\mu$m and preferably not thicker than the total thickness of charge transport layers provided under the uppermost layer.

As mentioned above, the photosensitive layer is prepared by coating and drying the predetermined layer. The amount of the residual solvent after drying is not more than 2 percent and preferably not more than 1.5 percent. In order to obtain such amount of the residual solvent, the drying temperature is between 90 to 120° C. and preferably between 95 and 120° C. When such amount of the residual solvent acquired, repeated characteristics are improved.

The electrically conductive support of the photoreceptor of the present invention include:

(1) metal plates such as an aluminum plate, a stainless steal plate, etc.

(2) those in which metal thin layer such as aluminum, palladium, gold, etc. is laminated or formed by evaporation on a support such as paper, plastic, etc. or evaporated on those supports.

(3) those in which a layer composed of electrically conductive compounds such as an electrically conductive polymer, indium oxide, tin oxide, etc. are coated or formed by evaporation on a support such as paper, plastic film, etc.

Each layer is formed on a support by coating such representatives as dip coating, spray coating, circle amount control type coating, etc.

The photoreceptor may be generally applied to digital electrophotographic apparatuses such as copiers, laser printers, LED printers, liquid crystal shutter type printers, etc. Furthermore, it may be applied to apparatuses such as displays, recorders, in-house printers, plate making machines, fax machines, etc., to which electrophotographic techniques are applied.

Figure 2:
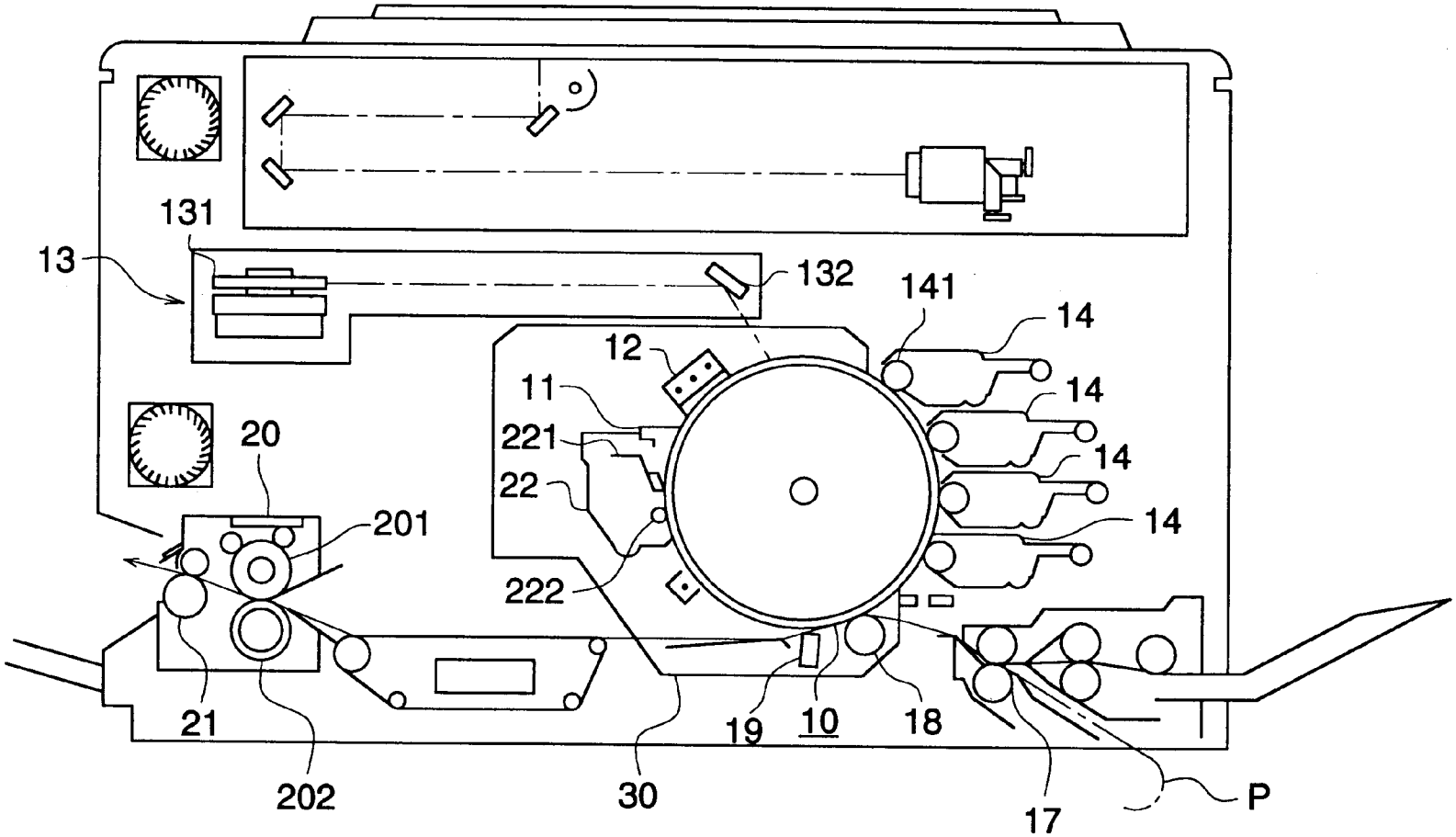
FIG. 2 shows a sectional view of the image-forming apparatus according to the present invention.

In FIG. 2, an example of sectional view of an associated image-forming apparatus is shown.

In FIG. 2, 10 is a photoreceptor drum employed as a image holding body, which comprises a drum having thereon a coated photosensitive layer containing Y type tinanylphthalocyanine, is grounded and drive rotated clockwise. Numeral 12 is a scorotron charging device and charges uniformly the circumference of the photoreceptor drum by corona discharging. Prior to charging by the charging device 12, charge may be eliminated by exposure employing an exposure section 11 composed of a light-emitting diode, etc. in order to erasing hysteresis of the photoreceptor at previous image-forming.

After charging uniformly the photoreceptor, an image exposure is performed by an image exposure means 13, being based on image signals. In the image exposure means 13 shown in FIG. 2, a light generated by a light source comprising a laser diode is curved by a reflection mirror 132 through a rotating polygon mirror 131, a fθ lens, etc. and scanning exposure is performed on the photoreceptor drum to form an electrostatic latent image.

The electrostatic latent is then developed by a development device 14. Around the photoreceptor drum 10, there are provided development devices 14 incorporating developers comprising each of yellow (Y), magenta (M), cyan (C), black (M) and other toners and a carrier. First color development is carried out by a rotating development sleeve 141 which has a built-in magnet and the developer. The developer consists of a carrier prepared by coating a insulating resin on ferrite employed as a core, a specified-color pigment made by polyester as a main material, a charge control agent, silica, titanium oxide, etc. The developer is regulated so as to form a layer having a thickness of 100 to 600 $\mu$m on the development sleeve by a layer-forming means and is conveyed to a development zone, and thus development is performed. At the time, the development is usually performed, while direct current or alternative current bias potential is applied to the gap between the photoreceptor drum 10 and the development sleeve 141.

In the formation of color images, after completing the formation of the first visual color image, the second color image-forming process starts. Uniform charging is again carried out by the charging device 12 and the second latent image is formed by the image exposure means 13. As for the third and forth images, the same image-forming process as that of the second is performed and four visual color images are formed on the circumference of the photoreceptor drum 10.

On the other hand, in a black-and-white electrophotographic apparatus, the development device 14 comprises only one kind of black toner and one development enables to form images.

A transfer sheet P is fed to a transfer zone by rotational operation of a sheet-feeding roller 17, when transfer timing is adjusted.

In the transfer zone, a transfer roller 18 is brought into pressure contact with the circumference of the photoreceptor drum 10, being synchronized with the transfer timing and the fed transfer sheet P is put between them and the multicolor images are simultaneously transferred.

Charge on the transfer sheet is eliminated by a separation brush 19 which is brought into pressure contact almost at the same time and the transfer sheet is separated from the circumference of the photoreceptor drum 10; conveyed to a fixing device 20; the toners are melt adhered by heat and pressure application by a heating roller 201; an application roller 202 and the resulting sheet is then taken out from the apparatus via a sheet-ejecting roller 21. Further, after passing the transfer sheet P, the above-mentioned transfer roller 18 and separation brush 19 withdraw from the circumference of the photoreceptor drum 10 so as to keep a gap and are prepared for the next toner image formation.

On the other hand, the photoreceptor drum from which the transfer sheet P is separated is subjected to removal and cleaning of the residual toner by pressure contact with a blade 221 of a cleaning device 22; is subjected to charge elimination by the exposure section 11 and charging by the charging device 12 and enters the next image-forming process. Further, when color images are superimposed on the photoreceptor, the above-mentioned blade 221 is moved soon after cleaning the surface of the photoreceptor, and withdraws from the circumference of the photoreceptor drum.

Further, 30 is a removable cartridge in which a charging means, a development means and a cleaning means are integrally united.

As an electrophotographic apparatus, of components such as the above-mentioned photoreceptor, development means, cleaning means, etc., a plurality of those components are integrally united and the united unit may be removably provided to the main body of the apparatus. For example, at least, one of a charging means, development means and cleaning means may be integrally held with the photoreceptor to form a single unit which is removably attached to the main body of the apparatus in such a way that a guiding means such as a rail is provided in the main body of the apparatus. At the time, it may be arranged in such a way that a charging means and/or a development means is attached to the side of the above-mentioned device unit.

The image exposure, when an electrophotographic apparatus is employed as a copier or printer, is carried out employing means in that a reflection or transmission light from an original document is irradiated on a photoreceptor, or an original document is read by a sensor to generate signals and based on the signals, light is irradiated on a photoreceptor by scanning a laser beam, driving a LED array or driving a liquid crystal shutter array.

Further, when employed as a printer of a fax machine, the image exposure means 13 performs an exposure enabling of printing received data.

EXAMPLE

The present invention is explained in detail with reference to examples mentioned below.

(Electrically Conductive Support)

An aluminum ingot was processed to a cylindrical shape having an outer diameter of 100 mm, a length of 360 mm and a wall thickness of 1.2 mm and the surface was then finished so as to have 10-point average roughness of 1 μm employing a lathe using a diamond bite.

(Sublayer)

Example 1

| | |
|---|---|
| Diamid X-1874M (polyamide resin, Daiseru Hyurusu Co., Ltd.) | 2 weight parts |
| Eposter S (0.3 μm) melamine resin, Nippon Shokubai Co., Ltd.) | 1 weight part |
| Methanol | 100 weight parts |

Example 2

| | |
|---|---|
| Diamid X-1874M (Daiseru Hyurusu Co., Ltd.) | 2 weight parts |
| Eposter S6 (0.6 μm) (melamine resin, Nippon Shokubai Co., Ltd.) | 1 weight part |
| Methanol | 100 weight parts |

Example 3

| | |
|---|---|
| Diamid X-1874M (Daiseru Hyurusu Co., Ltd.) | 2 weight parts |
| Microgel P-5002 (0.05 μm) (polymethylmethacrylate, Nippon Paint Co., Ltd.) | 1 weight part |
| Methanol | 100 weight parts |

Example 4

| | |
|---|---|
| Diamid X-1874M (Dariseru Hyurusu Co., Ltd.) | 3 weight parts |
| Microgel P-3101 (0.3 μm) (styrene resin, Nippon Paint Co., Ltd.) | 2 weight part |
| Methanol | 100 weight parts |

Example 5

| | |
|---|---|
| Diamid X-1874M (Daiseru Hyurusu Co., Ltd.) | 3 weight parts |
| Microgel P-3101 (0.3 μm) (styrene resin, Nippon Paint Co., Ltd.) | 0.2 weight part |
| Methanol | 100 weight parts |

Comparative Example 1

| | |
|---|---|
| Diamid X-1874M (Daiseru Hyurusu Co., Ltd.) | 3 weight parts |
| Methanol | 100 weight parts |

Comparative Example 2

(Electrically Conductive Support)

An aluminum ingot was processed to a cylindrical shape having an outer diameter of 100 mm, a length of 360 mm and a wall thickness of 1.2 mm and the surface was then finished so as to have 10-point average roughness of 2.5 μm employing a lathe using a diamond bite.

(Sublayer)

| | |
|---|---|
| Diamid X-1874M (Daiseru Hyurusu Co., Ltd.) | 3 weight parts |
| Methanol | 100 weight parts |

were mixed to prepare the sublayer liquid.

The resulting liquid was dip-coated on the above-mentioned support and the sublayer having a thickness of 0.5 μm was obtained.

(Charge Generating Later)

| | |
|---|---|
| G1 Y type titanylphthalocyanine | 4 weight parts |
| Silicone resin KR-5240 (Shin-Etsu Kagaku Kogyo Co., Ltd.) | 2 weight parts |
| 2-Butanone | 100 weight parts |

were mixed, dispersed on a sand mill for 10 minutes and the charge generating layer coating liquid was obtained. The resulting liquid was dip-coated on the above-mentioned sublayer and the charge generating layer having a thickness of 0.25 μm was obtained.

(Charge Transport Layer)

| | |
|---|---|
| T1 charge transport material | 8 weight parts |
| Bisphenol Z type polycarbonate Z-300 (Mitsubishi Gas Kagaku Co., Ltd. | 12 weight parts |
| 1.2-Dichloroethane | 100 weight parts |

were mixed and dissolved and the charge transport layer coating solution was obtained.

The resulting liquid was dip-coated on the above-mentioned charge generating layer and was subjected to heat treatment at 95° C. for one hour and the charge transport layer having a thickness of 25 μm was formed.

G1 Y type titanylphthalocyanine

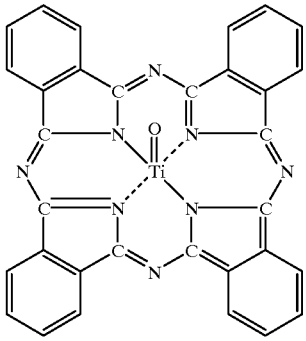

(2) T1 charge transport material

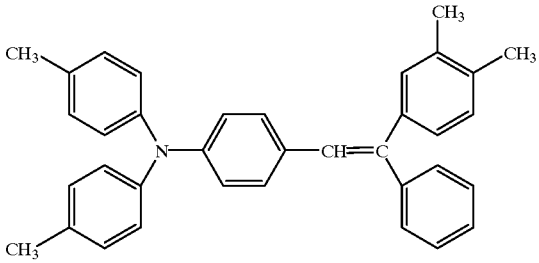

Evaluation Method and Results

Image quality tests were performed for each photoreceptor prepared as mentioned above.

Each photoreceptor was installed in the image-forming apparatus shown in FIG. 2 and the image evaluation was performed.

The image quality was evaluated in terms of letter printing characteristics. Letter image information was rendered to the photoreceptor and the quality of halftone image was evaluated which was formed on a plain paper through a normal image-forming process.

Expressions in the table

A=sharp and clear image quality.

B=some Moiré image but within the level for practical use

C=remarkable Moiré image and not suitable for practical use (Moiré image means grained interference fringes.)

TABLE 1

| | Image Quality |
|---|---|
| Example 1 | A |
| Example 2 | A |
| Example 3 | B |
| Example 4 | B |
| Example 5 | A |
| Comparative Example 1 | C |
| Comparative Example 2 | not evaluated due to appearance of processing traces of support |

As clearly seen from Table 1, image qualities of Examples 1 to 5 are excellent and acceptable for practical use. On the other hand, Comparative Examples show problems for practical use.

Being based on the present invention, in the electrophotographic photoreceptor employing a light capable of being subjected to interference as a light source, sharp and clear images are formed without the interference fringes generated at image formation and the generation of processing traces on an electrically conductive support.

Formation of Photoreceptor (Electrically Conductive Support)

An aluminum ingot was processed to a cylindrical shape having an outer diameter of 100 mm, a length of 360 mm and a wall thickness of 1.2 mm and the surface was then finished so as to have 10-point average roughness of 1 μm employing a lathe using a diamond bite.

(Sublayer)

Example 11

| | |
|---|---|
| Titanium chelate compound TC-750 (Matsumoto Seiyaku Co., Ltd.) | 20 weight parts |
| Silane coupling agent KBM-503 (Shin-Etsu Kagaku Kogyo Co., Ltd.) | 13 weight parts |
| Eposter S (0.3 μm) (melamine resin, Nippon Shokubai Co., Ltd.) | 10 weight parts |
| 2-Propanol | 100 weight parts |

Example 12

| | |
|---|---|
| Titanium chelate compound TC-750 (Matsumoto Seiyaku Co., Ltd.) | 20 weight parts |
| Silane coupling agent KBM-503 (Shin-Etsu Kagaku Kogyo Co., Ltd.) | 13 weight parts |
| Eposter S6 (0.6 μm) (melamine resin, Nippon Shokubai Co., Ltd.) | 10 weight parts |
| 2-Propanol | 100 weight parts |

Example 13

| | |
|---|---|
| Titanium chelate compound TC-750 (Matsumoto Seiyaku Co., Ltd.) | 20 weight parts |
| Silane coupling agent KBM-503 (Shin-Etsu Kagaku Kogyo Co., Ltd.) | 13 weight parts |
| Muticle PP240D (0.5 μm) (acrylic resin, Mitsui Toatsu Co., Ltd.) | 10 weight parts |
| 2-Propanol | 100 weight parts |

Example 14

| | |
|---|---|
| Titanium chelate compound TC-750 (Matsumoto Seiyaku Co., Ltd.) | 20 weight parts |
| Silane coupling agent KBM-503 (Shin-Etsu Kagaku Kogyo Co., Ltd.) | 13 weight parts |
| Microgel P-5002 (0.05 μm) (polymethylmethacrylate, Nippon Paint Co., Ltd.) | 10 weight parts |
| 2-Propanol | 100 weight parts |

Example 15

| | |
|---|---|
| Titanium chelate compound TC-750 (Matsumoto Seiyaku Co., Ltd.) | 20 weight parts |
| Silane coupling agent KBM-503 (Shin-Etsu Kagaku Kogyo Co., Ltd.) | 13 weight parts |
| Microgel P-3101 (0.3 μm) (styrene resin, Nippon Paint Co., Ltd.) | 2 weight parts |
| 2-Propanol | 100 weight parts |

Comparative Example 11

| | |
|---|---|
| Titanium chelate compound TIC-750 (Matsumoto Seiyaku Co., Ltd.) | 20 weight parts |
| Silane coupling agent KBM-503 (Shin-Etsu Kagaku Kogyo Co., Ltd.) | 13 weight parts |
| 2-Propanol | 100 weight parts |

were mixed to prepare a sublayer liquid.

The resulting liquid was dip-coated on the above-mentioned electrically conductive support and dried at 120° C. for 30 minutes. Thus the sublayer having a thickness of 1 μm was obtained.

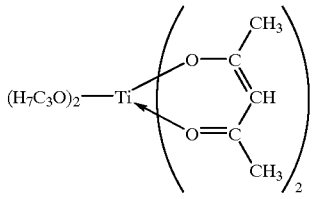

TC750 (Matsumoto Seiyaku Co., Ltd.)

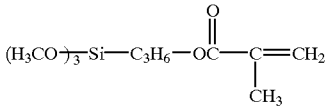

KBM503 (Shin-Etsu Kagaku Kogyo Co., Ltd.)

(Charge Generating Layer)

| | |
|---|---|
| G1 Y type titanylphthalocyanine | 4 weight parts |
| Silicone resin KR-5240 (Shin-Etsu Kagaku Kogyo Co., Ltd.) | 2 weight parts |
| 2-Butanone | 100 weight parts |

were mixed, dispersed on a sand mill for 10 minutes and the charge generating layer coating liquid was obtained. The resulting liquid was dip-coated on each of the above-mentioned sublayers and the charge generating layer having a thickness of 0.25 μm was obtained.

(Charge Transport Layer)

| | |
|---|---|
| T1 charge transport material | 8 weight parts |
| Bisphenol Z type polycarbonate Z-300 (Mitsubishi Gas Kagaku Co., Ltd. | 12 weight parts |
| 1.2-Dichloroethane | 100 weight parts |

were mixed and dissolved and the charge transport layer coating solution was obtained. The resulting liquid was dip-coated on the above-mentioned charge generating layer and was subjected to heat treatment at 95° C. for one hour and the charge transport layer having a thickness of 25 μm was formed.

G1 Y type tinatnylphthalocyanine

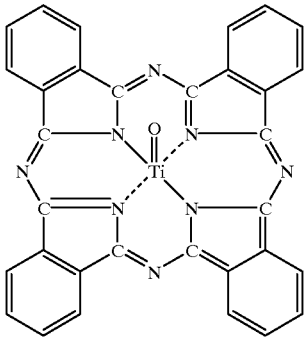

T1 charge transport material

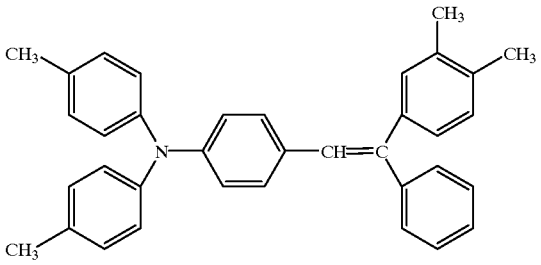

Evaluation Method and Results

Evaluation on the image quality was performed for each photoreceptor prepared as mentioned above.

Each photoreceptor was installed in the image-forming apparatus shown in FIG. 2 and the image evaluation was performed. The image quality was evaluated in terms of letter printing characteristics. Letter image information was rendered to the photoreceptor and the quality of halftone image was evaluated which was formed on a plain paper through a normal image-forming process.

Table 3 shows the results.

Expressions in the table

A=sharp and clear image quality.

B=some Moiré image but within the level for practical use

C=remarkable Moiré image and not suitable for practical use (Moiré image means grained interference fringes.)

TABLE 3

| | Image Quality |
|---|---|
| Example 11 | A |
| Example 12 | A |
| Example 13 | A |
| Example 14 | B |
| Example 15 | B |
| Comparative Example 11 | C |

According to the present invention, in the electrophotographic process having a laser exposure device, it is seen that it is possible to provide a photoreceptor exhibiting stable electric potential properties without causing Moiré images, etc. and an image-forming method and apparatus of use thereof.

We claim:

1. An electrophotographic photoreceptor comprising an electrically conductive support having thereon a photosensitive layer, and a sublayer between the support and the photosensitive layer, wherein the sublayer contains fine resin particles consisting essentially of resin.

2. The electrophotographic photoreceptor of claim 1, wherein the resins employed for resin particles is selected from a group consisting of silicone resin, polymethacrylate, polystyrene, crosslinked polystyrene, acrylic resin, styrene/acrylic resin, melamine resin, benzoguanamine/melamine resin, phenol resin, polytetrafluoroethylene, synthetic rubber, n-butylacrylate, urea resin, polyfluorovinylidene, urethane resin and cellulose acetate.

3. The electrophotographic photoreceptor of claim 1, wherein average particle diameter of the resin particles is 0.001 to 5 $\mu$m.

4. The electrophotographic photoreceptor of claim 1, wherein average particle diameter of the resin particles is more 0.04 to 1 $\mu$m.

5. The electrophotographic photoreceptor of claim 1, wherein thickness of the sublayer is from 0.05 to 10 $\mu$m.

6. The electrophotographic photoreceptor of claim 4, wherein the thickness of the sublayer is from 0.2 to 1 $\mu$m.

7. The electrophotographic photoreceptor of claim 1, wherein the sublayer comprises a resin binder and fine resin particles.

8. The electrophotographic photoreceptor of claim 7, wherein mixing weight ratio of the binder of the sublayer to the fine resin particles is fine resin particles/binder=1/10 to 50/10.

9. The electrophotographic photoreceptor of claim 8, wherein mixing weight ratio of the binder of the sublayer to the fine resin particles is in the range of fine resin particles/binder=3/10 to 5/10.

10. The electrophotographic photoreceptor of claim 7, wherein the binder resins of the sublayer is polyamide resin.

11. The electrophotographic photoreceptor of claim 1, wherein the sublayer comprises an organic metal compound selected from a metal alkoxide compound and a metal chelate compound or a silane coupling agent and fine resin particles.

12. The electrophotographic photoreceptor of claim 1, wherein the sublayer comprises an organic metal compound selected from a metal alkoxide compound and a metal chelate compound, a silane coupling agent, and fine resin particles.

13. The electrophotographic photoreceptor of claim 11, wherein mixing weight ratio of the binder of the sublayer to the fine resin particles is fine resin particles/binder=1/10 to 50/10.

14. The electrophotographic photoreceptor of claim 13, wherein mixing weight ratio of the binder of the sublayer to the fine resin particles is in the range of fine resin particles/binder=3/10 to 5/10.

15. An image-forming process using the electrophotographic photoreceptor of claim 1 wherein the image is formed on the photoreceptor by digital writing employing a laser beam.

16. An image-forming process using the electrophotographic photoreceptor of claim 1 wherein the image is formed on the photoreceptor by superimposing a plurality of colored toners and then the colored toners are simultaneously transferred to a transfer sheet.

17. The image-forming process of claim 16 wherein the colored toner comprises a yellow toner, a magenta toner and a cyan toner.

18. The image-forming process of claim 16 wherein the colored toner comprises a yellow toner, a magenta toner, a cyan toner and black toner.

19. An electrophotographic photoreceptor comprising an electrically conductive support having thereon a photosensitive layer, and a sublayer between the support and the photosensitive layer, wherein the sublayer contains fine resin particles and resistance of the fine resin particle is not less than $10^7$ Ω·cm.

* * * * *